US011107653B2

(12) United States Patent
Zhou

(10) Patent No.: US 11,107,653 B2
(45) Date of Patent: Aug. 31, 2021

(54) DUAL-ACTION SWITCHING MECHANISM AND POLE UNIT FOR CIRCUIT BREAKER

(71) Applicant: Eaton Intelligent Power Limited, Dublin (IE)

(72) Inventor: Xin Zhou, Wexford, PA (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 16/907,609

(22) Filed: Jun. 22, 2020

(65) Prior Publication Data

US 2020/0411262 A1 Dec. 31, 2020

Related U.S. Application Data

(60) Provisional application No. 62/866,774, filed on Jun. 26, 2019.

(51) Int. Cl.

| | |
|---|---|
| ***H01H 3/22*** | (2006.01) |
| ***H01H 33/02*** | (2006.01) |
| ***H01H 33/666*** | (2006.01) |
| ***H01H 50/20*** | (2006.01) |
| ***H01H 50/44*** | (2006.01) |

(52) U.S. Cl.

CPC ..... *H01H 33/6662* (2013.01); *H01H 3/222* (2013.01); *H01H 33/022* (2013.01); *H01H 50/20* (2013.01); *H01H 50/443* (2013.01)

(58) Field of Classification Search

CPC ..... H01H 3/222; H01H 3/26; H01H 3/28; H01H 3/30; H01H 3/32; H01H 3/56; H01H 2003/266; H01H 2003/268; H01H 33/022; H01H 33/38; H01H 33/285; H01H 33/596; H01H 33/6662; H01H 33/666;

(Continued)

(56) References Cited

U.S. PATENT DOCUMENTS 3,026,394 A 3/1962 Emmett
3,405,245 A 10/1968 Ito (Continued)

OTHER PUBLICATIONS

Bini, R. et al., "Interruption Technologies for HVDC Transmission: State-of-Art and Outlook", 2017 4th International Conference on Electric Power Equipment—Switching Technology-Van-China, downloaded May 12, 2020.

(Continued)

*Primary Examiner* — William A Bolton
(74) *Attorney, Agent, or Firm* — Fox Rothschild LLP

(57) ABSTRACT

A circuit breaker includes a pole unit with a moveable electrode and a fixed electrode. A resilient member is operably connected to a first end of the pole unit. A linkage extends from the second end of the pole unit and operably connects to the moveable electrode. A linear actuator is operably connected to the linkage and located away from the pole unit. A Thomson coil or other high-speed actuator is also operably connected to the linkage. A gap is provided between the pole unit and the linear actuator member when the resilient member is not extended. To open the electrodes, the high-speed actuator first acts on the linkage by pulling the movable electrode away from the fixed electrode. The linear actuator then actuates and increases the distance between the contacts of the breaker by pulling the pole unit toward it, closing the gap.

20 Claims, 8 Drawing Sheets

(58) Field of Classification Search
CPC .. H01H 50/20; H01H 50/443; H01H 71/2463; H01H 71/2481; H01H 71/7463
USPC ..... 218/154, 120, 140, 153, 10; 335/51, 80, 335/147, 151, 192, 193, 201, 202
See application file for complete search history.

(56) References Cited

U.S. PATENT DOCUMENTS 3,534,304 A * 10/1970 Robinson ..... H01H 33/666 335/16
4,107,496 A 8/1978 Clason
4,250,363 A 2/1981 Heberlein et al.
4,281,231 A 7/1981 Griesen et al.
6,930,271 B1 8/2005 Palmieri et al.
7,739,058 B2 * 6/2010 Maruyama ..... H01F 7/1844 702/34
7,829,814 B2 11/2010 Marchand et al.
8,680,956 B2 * 3/2014 Kim ..... H01H 1/502 335/179
8,982,538 B2 3/2015 Leccia et al.
9,165,726 B2 10/2015 Dohnal et al.
9,183,996 B2 11/2015 Karlstrom et al.
9,196,439 B2 11/2015 Gentsch
9,396,896 B2 7/2016 Chen et al.
9,431,184 B2 * 8/2016 Lee ..... H01H 33/6662
9,478,383 B2 * 10/2016 Lee ..... H01H 83/02
9,508,514 B2 * 11/2016 Ohda ..... H01F 7/122
9,741,513 B2 8/2017 Schmitz et al.
9,842,713 B2 12/2017 Yu et al.
10,580,599 B1 3/2020 Wang et al.
2012/0274428 A1 * 11/2012 Reuber ..... H01H 33/6662 335/6
2017/0154747 A1 6/2017 Bissal et al.
2017/0352507 A1 12/2017 Kim et al.

OTHER PUBLICATIONS

Pei, X. et al., "Fast operating moving coil actuator for a vacuum", IEEE Transactions on Energy Conversion, 32(3), 931-940, 2017.

* cited by examiner

DUAL-ACTION SWITCHING MECHANISM AND POLE UNIT FOR CIRCUIT BREAKER

RELATED APPLICATIONS AND CLAIM OF PRIORITY

This patent document claims priority to U.S. Provisional Patent Application No. 62/866,774, filed Jun. 26, 2019. The disclosure of the priority application is fully incorporated into this document by reference.

BACKGROUND

Circuit breakers, sometimes referred to as circuit interrupters, include electrical contacts that connect to each other to pass current from a source to a load. The contacts may be separated in order to interrupt the delivery of current, either in response to a command or to protect electrical systems from electrical fault conditions such as current overloads, short circuits, and high or low voltage conditions.

In certain medium voltage circuit breakers, for example medium voltage hybrid circuit breakers, it is desirable to have a vacuum interrupter in which the contacts move with a fast opening speed. Some ultra-fast switching mechanisms can open the contacts in as few as 500 microseconds, with speeds of travel approaching 4 m/s. In conditions that approach short circuit conditions, the circuit breaker must achieve a sufficiently large contact gap (typically 1.5 mm or 2 mm) in this short time frame. Traditional motor-driven and linear actuators cannot achieve such opening speeds.

To address this, some have proposed using a Thomson coil as the actuator. However, Thomson coils have a limited opening distance and cannot achieve the contact cap that is desirable in normal conditions, or to hold the circuit breaker open after interruption.

This document describes methods and systems that are intended to address some or all of the problems described above.

SUMMARY

In various embodiments, a circuit breaker includes a pole unit that comprises a moveable electrode that leads to a moveable contact, and a fixed electrode that leads to a fixed contact. The pole unit includes a first end that is relatively proximate to the fixed electrode, and a second end that is relatively proximate to the moveable electrode. A resilient member may be operably connected to and positioned proximate to the first end of the pole unit. A linkage extends from the second end of the pole unit. A linear actuator is operably connected to the linkage and located away from the pole unit. In addition, a high-speed actuator is also operably connected to the linkage. The high-speed actuator is operable to move the linkage at a speed that is faster than a speed by which the linear actuator can move the linkage. When the resilient member is not in an extended position (i.e., when the contacts are closed), a gap will be provided between the pole unit and either the high-speed actuator or the linear actuator (whichever is closer to the pole unit). When the resilient member is in an extended position (i.e., when the contacts are open), the gap will be reduced or eliminated.

Optionally, the linear actuator may be positioned between the pole unit and the high-speed actuator, and in this case the gap will be between the pole unit and the linear actuator. Alternatively, the high-speed actuator may be positioned between the pole unit and the linear actuator, and in this case the gap will be between the pole unit and the high-speed actuator.

Optionally, the high-speed actuator may comprise a Thomson coil actuator. The Thomson coil actuator may include a first Thomson coil, a second Thomson coil, and a conductive plate positioned between the first and second Thomson coils. The linkage may pass through the first Thomson coil and be positioned to be driven by the conductive plate.

Optionally, the circuit breaker may include a stop member that is positioned at an end of the gap to limit travel of the pole unit toward the linear actuator. Optionally, the resilient member, when included, may be at least partially contained inside of the pole unit. Alternatively, the resilient member may be at least partially positioned outside of the pole unit.

Optionally, the circuit breaker may include a driver that is configured to open the circuit breaker by: (1) energizing the high-speed actuator to draw the linkage and separate the contacts by a distance; and (2) after energizing the high-speed actuator, energizing the linear actuator to apply a force to the linkage that will pull the pole unit toward the linear actuator, thus increasing the distance between the contacts, extending the resilient member, and reducing or closing the gap between the pole unit and the linear actuator.

Optionally, the pole unit also may include a vacuum chamber, and the fixed electrode and the movable electrode may be contained within the vacuum chamber.

BRIEF DESCRIPTION OF THE DRAWINGS

FIG. 1A illustrates an example circuit breaker, while

FIG. 4A illustrates a first variation of the circuit breaker, while

FIG. 6A illustrates a second variation of the circuit breaker, while

DETAILED DESCRIPTION

As used in this document, the singular forms "a," "an," and "the" include plural references unless the context clearly dictates otherwise. Unless defined otherwise, all technical and scientific terms used in this document have the same meanings as commonly understood by one of ordinary skill in the art. As used in this document, the term "comprising" (or "comprises") means "including (or includes), but not limited to." When used in this document, the term "exemplary" is intended to mean "by way of example" and is not intended to indicate that a particular exemplary item is preferred or required.

In this document, when terms such "first" and "second" are used to modify a noun, such use is simply intended to distinguish one item from another, and is not intended to require a sequential order unless specifically stated. The term "approximately," when used in connection with a numeric value, is intended to include values that are close to, but not exactly, the number. For example, in some embodiments, the term "approximately" may include values that are within +/−10 percent of the value.

When used in this document, terms such as "top" and "bottom," "upper" and "lower", or "front" and "rear," are not intended to have absolute orientations but are instead intended to describe relative positions of various components with respect to each other. For example, a first component may be an "upper" component and a second component may be a "lower" component when a device of which the components are a part is oriented in a direction in which those components are so oriented with respect to each other. The relative orientations of the components may be reversed, or the components may be on the same plane, if the orientation of the structure that contains the components is changed. The claims are intended to include all orientations of a device containing such components.

In this document, the term "electrically connected", when referring to two electrical components, means that a conductive path exists between the two components. The path may be a direct path, or an indirect path through one or more intermediary components.

"Medium voltage" (MV) systems include electrical systems that are rated to handle voltages from about 600 V to about 1000 kV. Some standards define MV as including the voltage range of 600 V to about 69 kV. (See NECA/NEMA 600-2003). Other standards include ranges that have a lower end of 1 kV, 1.5 kV or 2.4 kV and an upper end of 35 kV, 38 kV, 65 kV or 69 kV. (See, for example, IEC 60038, ANSI/IEEE 1585-200 and IEEE Std. 1623-2004, which define MV as 1 kV-35 kV.) Except where stated otherwise, in this document the term "medium voltage" is intended to include the voltage range from approximately 1 kV to approximately 100 kV, as well as all possible sub-ranges within that range, such as approximately 1 kV to approximately 38 kV.

Figure 1A:
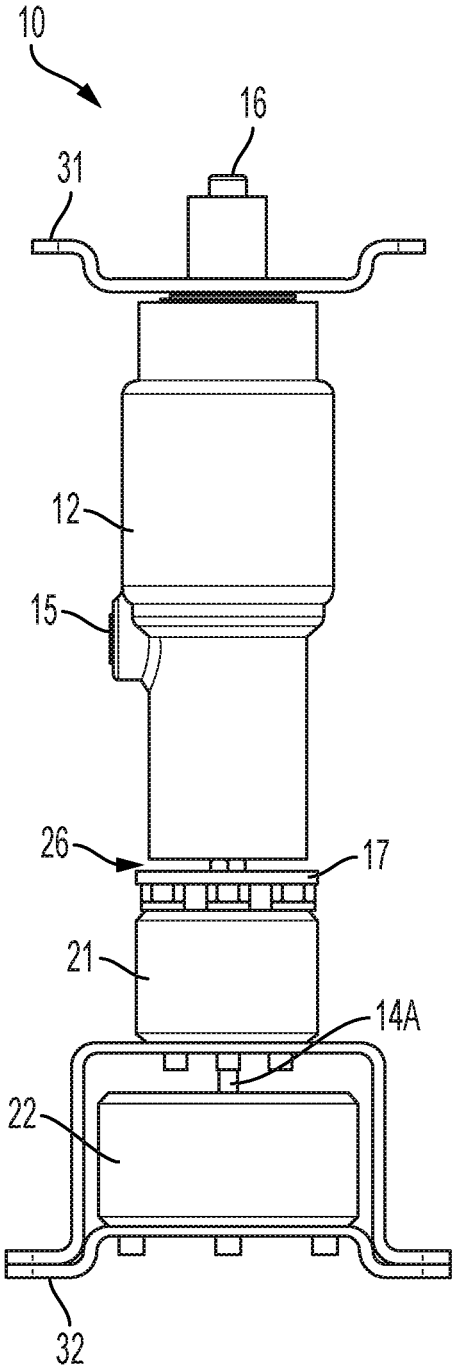
Figure 1B:
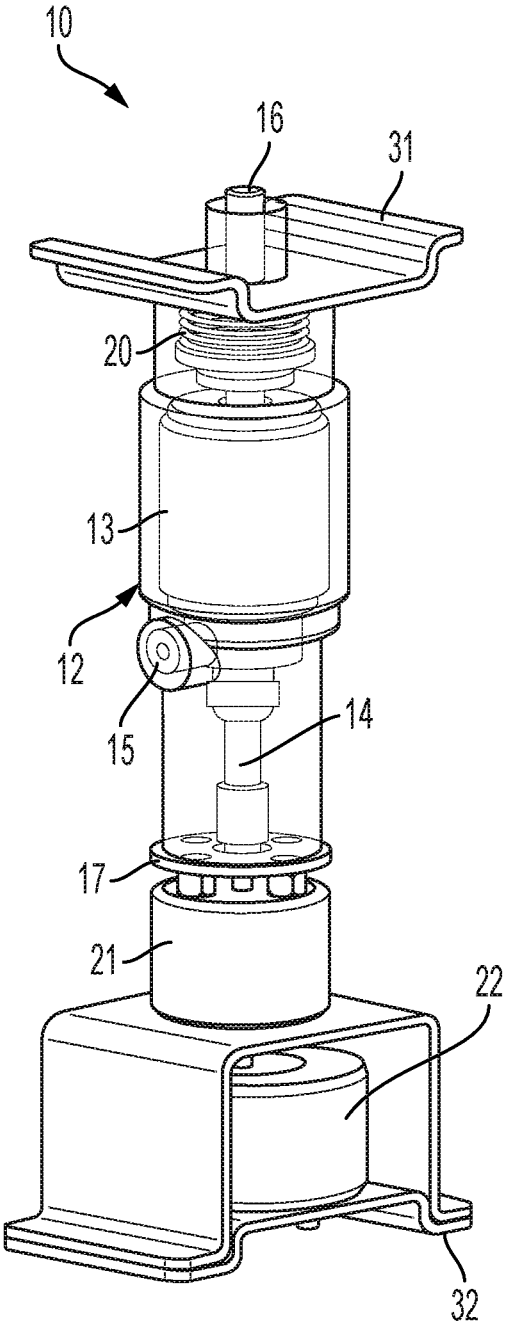
FIG. 1B illustrates the circuit breaker with certain internal components shown.

Referring to FIGS. 1A and 1B, a circuit breaker or a vacuum interrupter switch 10 in accordance with an aspect of the disclosure is shown. In some embodiments, the circuit breaker or a vacuum interrupter switch 10 may be employed in a direct current (DC) system to interrupt DC power. In other embodiments, the circuit interrupter 10 may be employed in an alternating current (AC) circuit, for example as a single pole of a three-pole AC circuit breaker.

The circuit breaker 10 (which may include a vacuum interrupter switch that is a component of circuit breaker 10) includes a pole unit 12 that contains a vacuum interrupter 13. Referring to the cross-sectional views of FIGS. 2A and 2B, the vacuum interrupter 13 includes a housing that contains a sealed vacuum chamber that holds a moveable electrode 29 that leads to a moveable contact 19, and a fixed electrode 28 that leads to a fixed contact 18. The moveable electrode 29 and moveable contact 19 are electrically connected to a first terminal 15, and the fixed electrode 28 and fixed contact 18 are electrically connected to a second terminal 16. The terminals 15, 16 extend from the pole unit 12 such that one of the terminals 15 or 16 may be electrically connected to a power source and the other terminal may be electrically connected to a load, thus positioning the vacuum interrupter 13 to interrupt the delivery of power to the load when the contacts are separated.

With continued reference to FIGS. 1A and 1B, a linkage 14 that includes one or more arms or other collective structures formed of a non-conductive (insulating) material extends from the moveable electrode 29 to and beyond an end of the pole unit 12 that is relatively proximate to the moveable electrode 29. (In this discussion, the term "relatively proximate" to a point means that the referenced item is closer to that point than an alternate point. For example, in this situation, it means that this refers to an end of the pole unit 12 that is closer to the moveable electrode 29 than it is to the fixed electrode 28.) The cross section view of FIG. 2A illustrates that the linkage may include one or more components (such as conductive rod 14A) that extend beyond the pole unit 12, one or more components (such as non-conductive linking connector 14B that mechanically connects the moveable electrode 29 with the conductive rod 14A) that are included within the pole unit, and any variation of intermediate interconnecting components that operate so that when the external components 14A are pulled or pushed, the internal components 14B will be moved by a corresponding force.

The breaker also includes a linear actuator 21 and a high-speed actuator 22 that are mechanically positioned in series so that the linear actuator 21 is positioned between the high-speed actuator 22 and the pole unit 12. A segment 14A of the linkage extends from the pole unit 12, through the linear actuator 21, to the high-speed actuator 22. Linkage segment 14A may be connected to a conductive plate in certain high-speed actuators, as will be described below in the discussion of FIG. 3.

The breaker also includes a resilient member 20 positioned at a second end of the pole unit 12. The second end of the pole unit 12 is the end opposite the first end, and is the end that is relatively proximate to the fixed electrode 28. (In other words, the second end of the pole unit 12 is closer to the fixed electrode than it is to the moveable electrode 29.) The resilient member 20 may be, for example, a contact spring. The resilient member 20 may be at partially inside of the pole unit 12 and/or at least partially outside of the pole unit 12. The resilient member 20 is directly or indirectly connected to a mounting bracket 31, either directly or indirectly via one or more components.

Figure 2A:
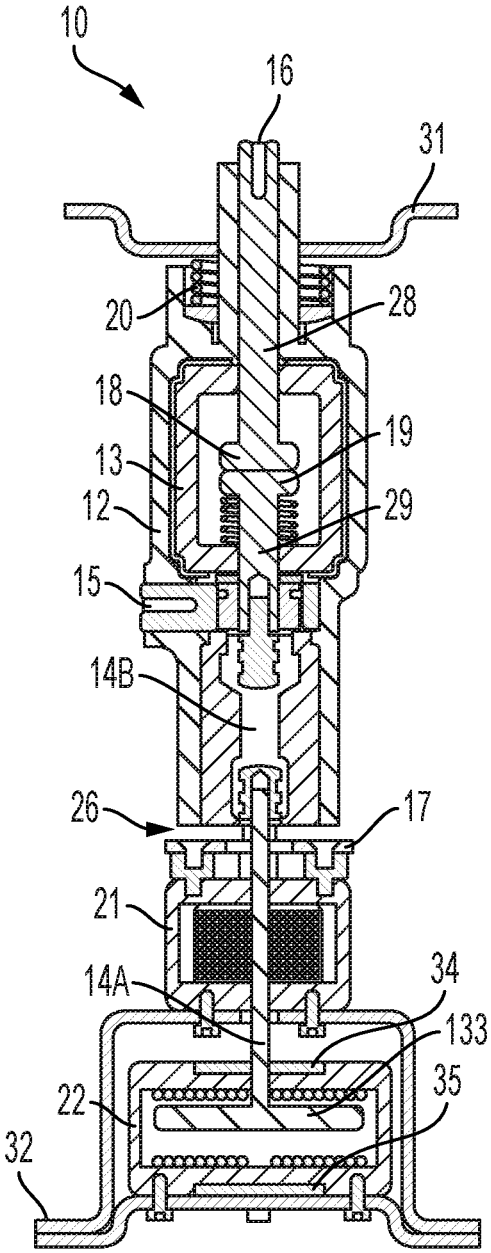
FIG. 2A illustrates a cross-sectional view of the circuit breaker in a closed position.

FIGS. 1A and 2A illustrate the circuit breaker 10 in a closed position. In this position, the fixed contact 18 and moveable contact 19 are in contact, providing a conductive path between the terminals 15, 16. The resilient member 20 is in a relaxed/non-extended position when the circuit breaker is closed, and a gap 26 exists between the pole unit 12 and the linear actuator 21.

Figure 2B:
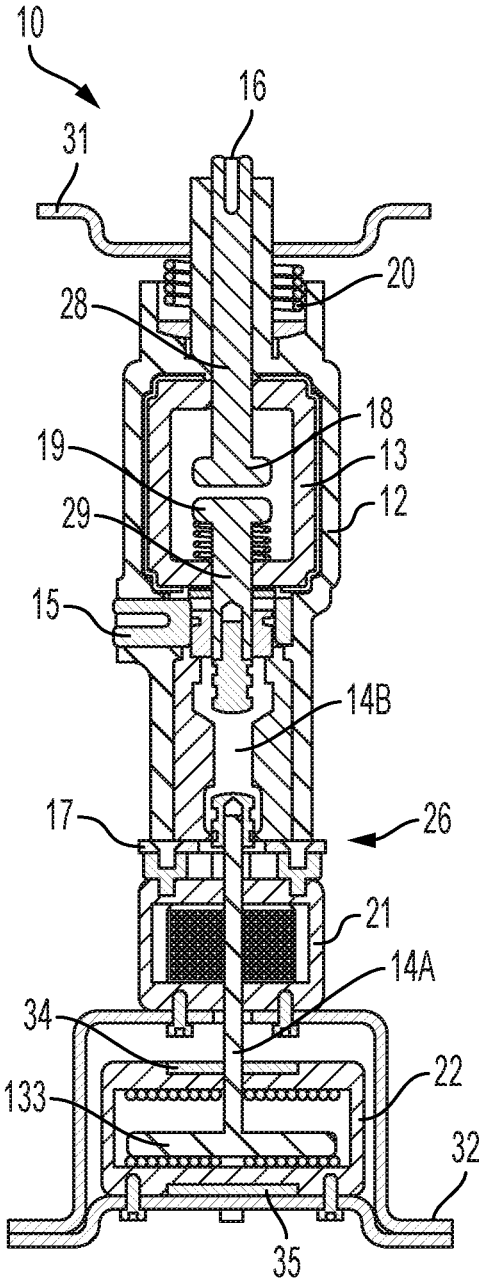
FIG. 2B illustrates a cross-sectional view of the circuit breaker in an open position.

FIGS. 1B and 2B illustrate the circuit breaker 10 in an open position. In this position, the fixed contact 18 and moveable contact 19 are separated, thus interrupting the conductive path between the terminals 15, 16. The resilient member 20 is in an extended position when the circuit breaker is open, and the gap 26 between the pole unit 12 and the linear actuator 21 is reduced or eliminated. A stop member 17 such as a plate or other structure may be positioned at the end of the gap 26 and connected with the linear actuator 21 to limit the path of travel of the pole unit 12 toward the linear actuator 21.

The circuit breaker or a vacuum interrupter switch 10 includes mounting brackets 31, 32 or other mounting structures at each end so that the distance between the mounting brackets 31, 32 or other ending structures remains fixed when the breaker or a vacuum interrupter switch 10 is open or closed. One of the mounting structures 32 may also serve to interconnect the linear actuator 21 and the high-speed actuator 22 while maintaining a distance between the two actuators along which the conductive rod 14A of the linkage 14 may be withdrawn to open the contacts or released to close the contacts.

In normal operation, such as conditions in which the current is at or below the rated current of the circuit breaker, the linear actuator 21 may operate to open and close the vacuum interrupter 13. The linear actuator 21 may be for example, a solenoid; a magnetic actuator; or a dual coil in-line actuator. The dual coil in-line actuator will include a first coil and a second coil, one of which is wound in a clockwise direction, and the other of which is wound in a counterclockwise direction. The coils will be wound around the linkage 14 so that when one coil is energized, it will generate an electric field that operates to pull the linkage 14 in a first direction that moves the moveable electrode 29 and moveable contact 19 away from the fixed electrode 28 and fixed contact 18. When the other coil is energized, it will generate an opposite electric field that operates to push the linkage in a second direction that moves the moveable contact 19 toward the fixed contact 18. Other linear actuators may be employed, for example such as that shown and described in FIG. 14 and the corresponding text of U.S. Pat. No. 6,930,271, the disclosure of which is fully incorporated into this document by reference.

The high-speed actuator 22 is operable to separate the moveable and fixed electrodes at a speed that is higher than the fastest speed that the linear actuator 21 can achieve. For example, traditional linear actuators in medium voltage applications have an operating speed that can not move and separate the electrodes at a speed of about 4 m/s. In medium voltage applications of the present disclosure, the high-speed actuator 22 may be have an operating speed that can move the linkage 14 at a faster speed such that a gap of from 1.5 mm to 2.0 mm may be opened between the electrodes in less than 0.5 milliseconds. Other gap sizes and speeds may be possible in various embodiments. Such high opening speeds are important when the breaker has to withstand the transient recovery voltage (TRV) and follow-up system voltage after overload current or short circuit current interruption. Thus, the linear actuator may have a speed sufficient for a rated voltage of the breaker (e.g., 6 KV), but a faster opening speed may be required if, for example, overload event or short circuit event occurs.

Figure 3:
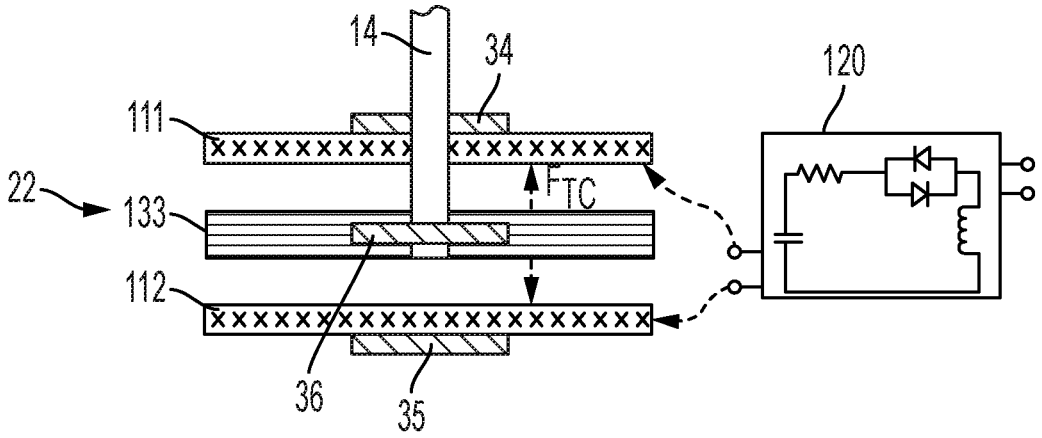
FIG. 3 illustrates components of a Thomson coil that may be used as a high-speed actuator.

Example high-speed actuators 22 that can achieve such opening speeds include a Thomson coil actuator or a piezoelectric actuator. FIG. 3 illustrates an example Thomson coil actuator 22 that includes a first Thomson coil 111, a second Thomson coil 112, and a conductive plate 133 positioned between the first and second Thomson coils to serve as an armature. At least the first Thomson coil 111, and optionally also the second Thomson coil 112, is a relatively flat spiral coil that is wound in either a clockwise or counterclockwise direction around the linkage 14. The conductive plate 133 may be in the form of a disc or other structure that is connected to the linkage 14 to serve as an armature that may drive the linkage 14 in one direction or the other. The linkage 14 passes through the center of the Thomson coil 111 that receives the linkage from the vacuum interrupter via the linear actuator. Each Thomson coil 111, 112 is electrically connected to a driver 120.

The driver 120 may selectively energize either the first Thomson coil 111 or the second Thomson coil 112. When the driver 120 energizes the first Thomson coil 111, the first Thomson coil 111 will generate a magnetic force that will repel the conductive plate 133 away from the first Thomson coil 111 and toward the second Thomson coil 112. This causes the linkage 14 to move in a downward direction in the orientation shown, which moves the moveable electrode away from the fixed electrode in the vacuum interrupter and opens the circuit. In some embodiments, such as those in which a fast closing operation is desired, when the driver 120 energizes the second Thomson coil 112, the second Thomson coil 112 will generate a magnetic force that will repel the conductive plate 133 away from the second Thomson coil 112 and toward the first Thomson coil 111. This causes the linkage 14 to move in an upward direction in the orientation shown, which moves the moveable electrode toward the fixed electrode in the vacuum interrupter and closes the circuit.

The Thomson coil actuator also may include permanent magnets 34, 35 positioned proximate to each Thomson coil 111, 112, and a permanent magnet 36 on the conductive plate 133, that will latch the conductive plate 133 with the Thomson coil (111 or 112) to which it is adjacent. When a Thomson coil (111 or 112) to which the conductive plate is latched is energized, the magnetic repulsion force will push the conductive plate 133 toward the other Thomson coil and operate to de-latch the plate 133 from its current position.

The Thomson coil thus allows for fast operation when needed. However, a Thomson coil can typically open only a small gap (e.g., 2 mm) at very high opening speed, which is fine for initial operation but not necessarily for what is desired to completely open the circuit and/or maintain it in an open position. For example, in 6 kV medium voltage applications, it is desired to separate the contacts by at least 6 mm to achieve a fully-open condition so that the vacuum interrupter can have a 27 kV withstand voltage rating and 75 kV basic insulation level (BIL) rating.

The combination of a linear actuator 21 in line with a high-speed actuator 22 can help to accomplish this. In operation, one or more drivers (such as driver 120 in FIG. 3) may cause the Thomson coil (or other high-speed actuator 22) to first actuate, energize and pull the linkage away, separating the contacts 18, 19 in the vacuum interrupter. After the high-speed actuator 22 is engaged, and either while it is still engaged or upon completion of its operation, the driver may actuate the linear actuator 21, which will apply a force to linkage 14 to try to extend the gap between the contacts 18, 19. However, because the path of travel of the linkage 14 will be restricted when the high-speed actuator 22 has pulled the linkage 14 to the end of its path of travel, the linear actuator's force on the linkage 14 will draw the entire pole unit 12 toward the linear actuator 21, thus extending the gap between the contacts 18, 19, for example to approximately 6 mm. The resilient member 20 will also thus extend, and the gap 26 between the pole unit 12 and linear actuator 21 will be reduced, and optionally closed when the pole unit 12 reaches the stop member 17.

Optionally, instead of the linear actuator being positioned between the high-speed actuator and the pole unit, the high-speed actuator may be positioned between the linear actuator and the pole unit. This variation will be discussed below in the context of FIGS. 6A-7B.

Figure 4A:
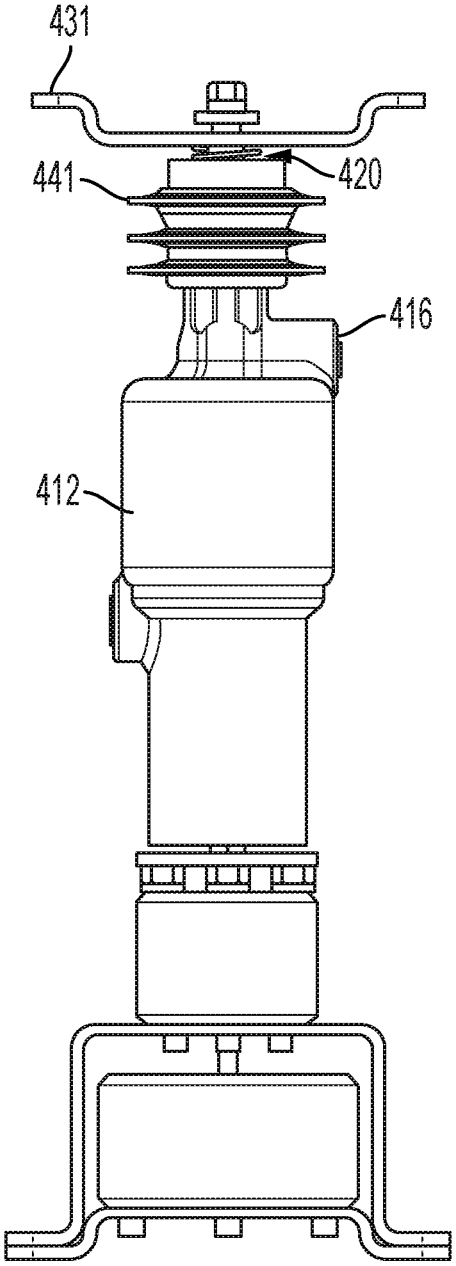
Figure 4B:
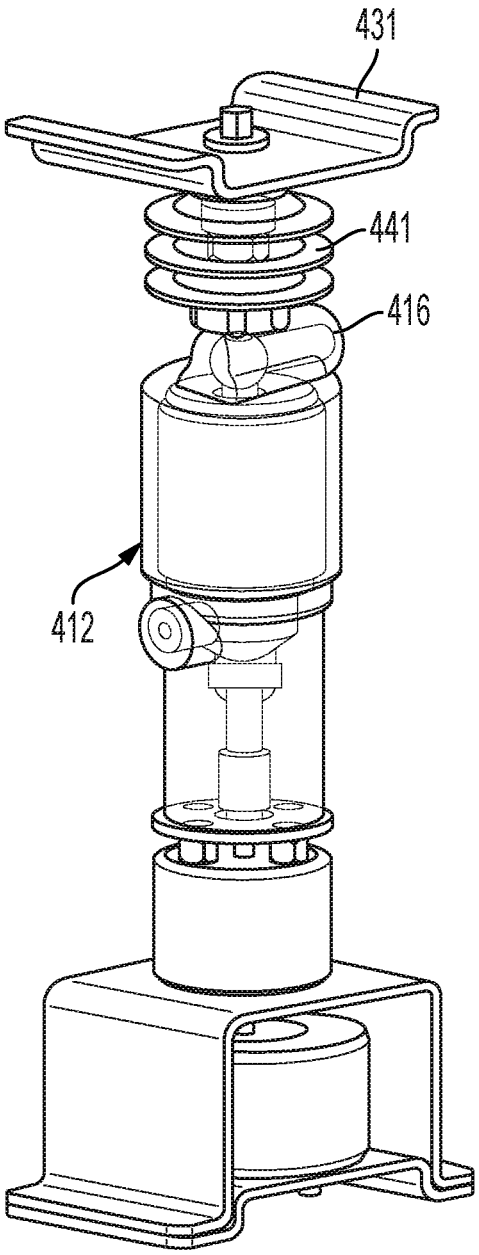
FIG. 4B illustrates the first variation with certain internal components shown.
Figure 5A:
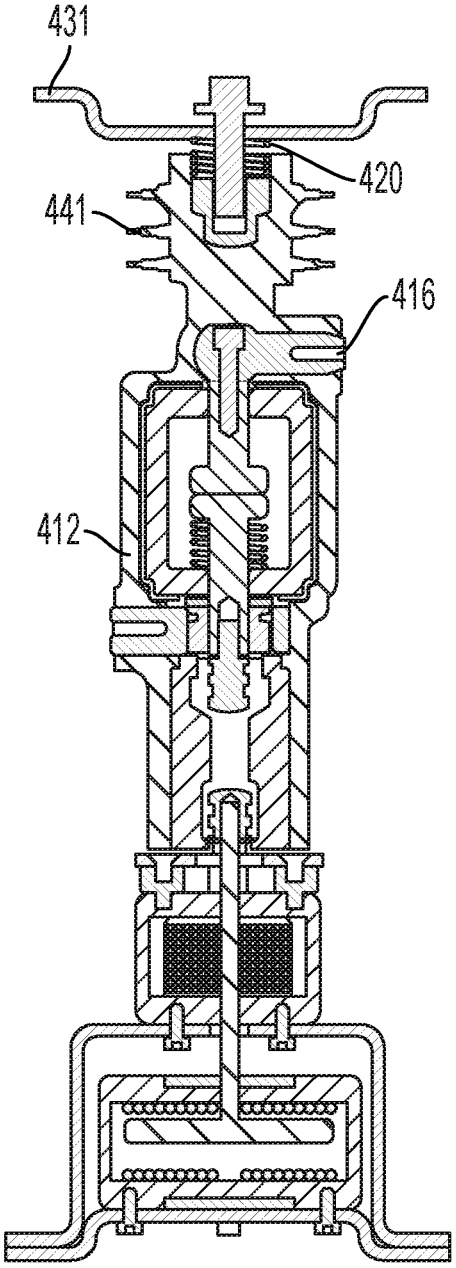
FIG. 5A illustrates a cross-sectional view of the first variation in a closed position.
Figure 5B:
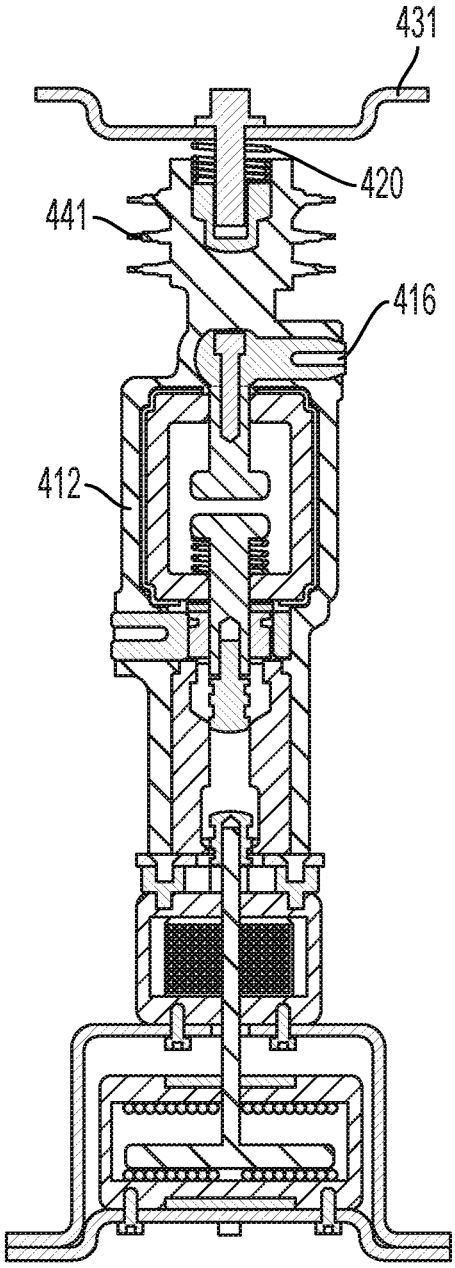
FIG. 5B illustrates a cross-sectional view of the first variation in an open position.

FIGS. 4A and 4B illustrate an alternative embodiment in which instead of extending through the resilient member and mounting bracket as shown in FIGS. 1A-1B and 2A-2B, the terminal 416 that connects to the fixed member extends out of the pole unit 412 before it reaches an isolating component 441. The isolating component is made of a non-conductive material, optionally with ribs as shown to increase its surface area, that provides a physical and electrical barrier that separates the pole unit 412 from the mounting bracket 431. The resilient member 420 extends from the isolating component 441 toward the mounting bracket 431. This arrangement is also shown in the cross-sectional views of FIG. 5A (closed position) and FIG. 5B (open position).

Figure 6A:
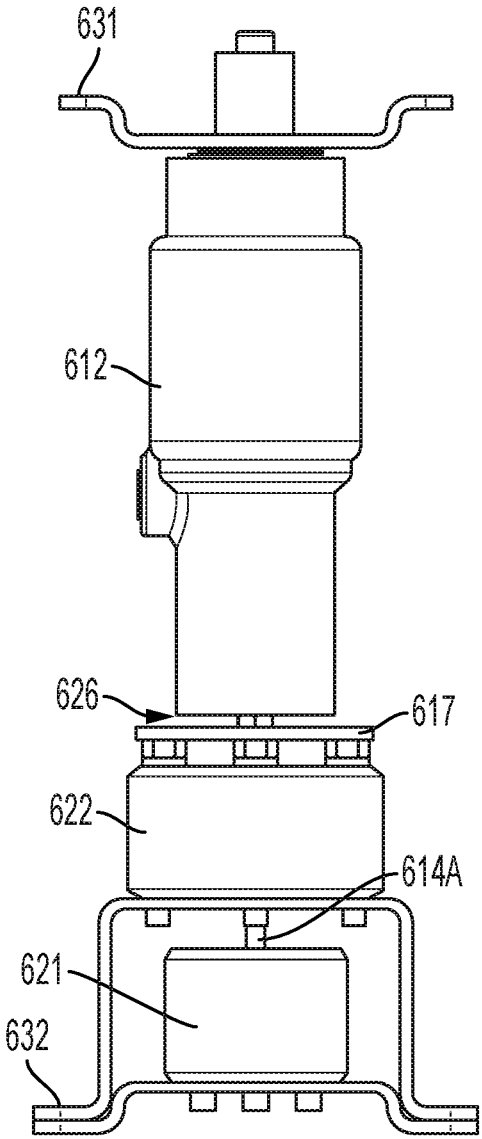
Figure 6B:
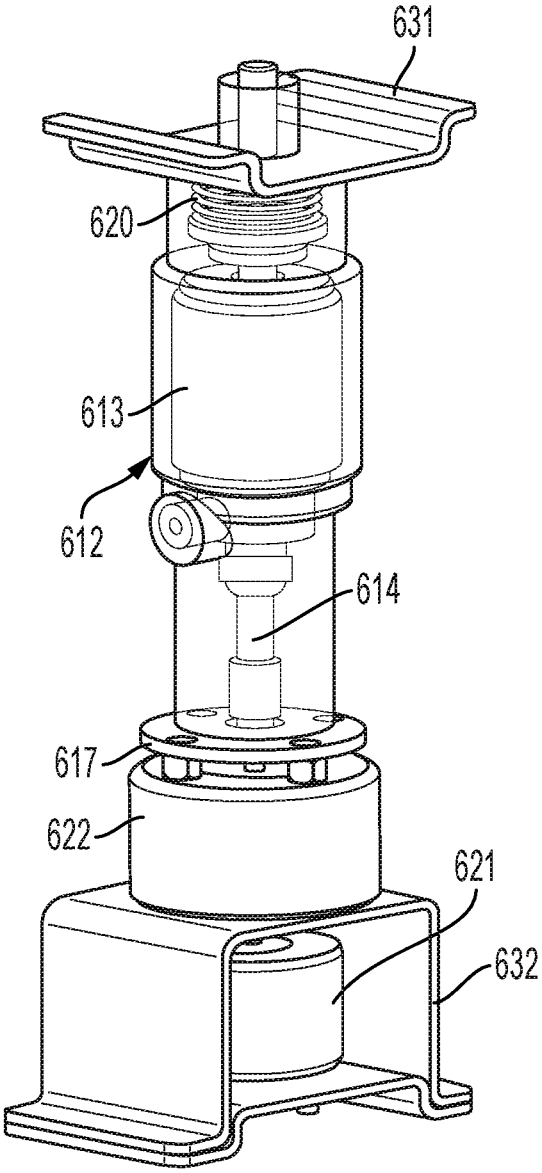
FIG. 6B illustrates the second variation with certain internal components shown.
Figure 7A:
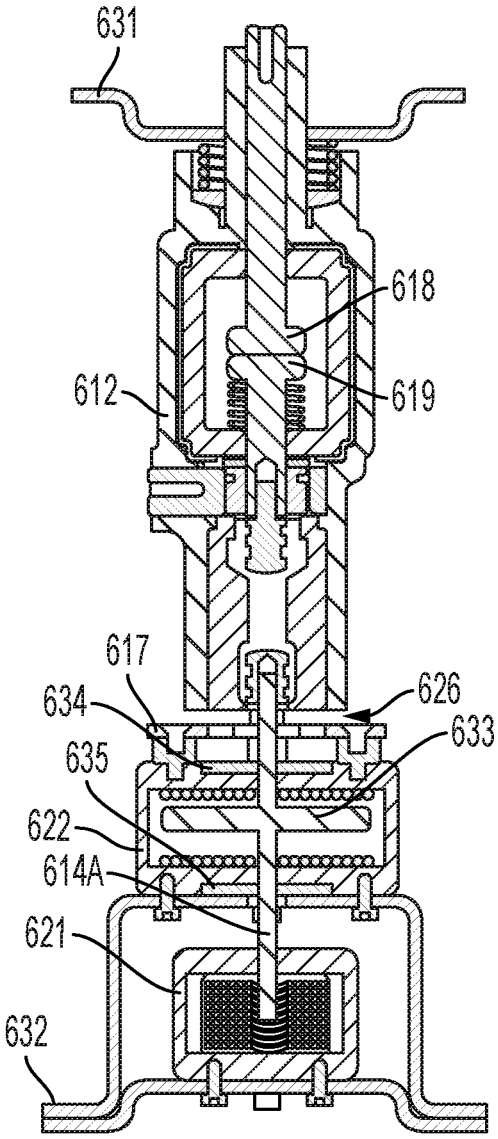
FIG. 7A illustrates a cross-sectional view of the second variation in a closed position.
Figure 7B:
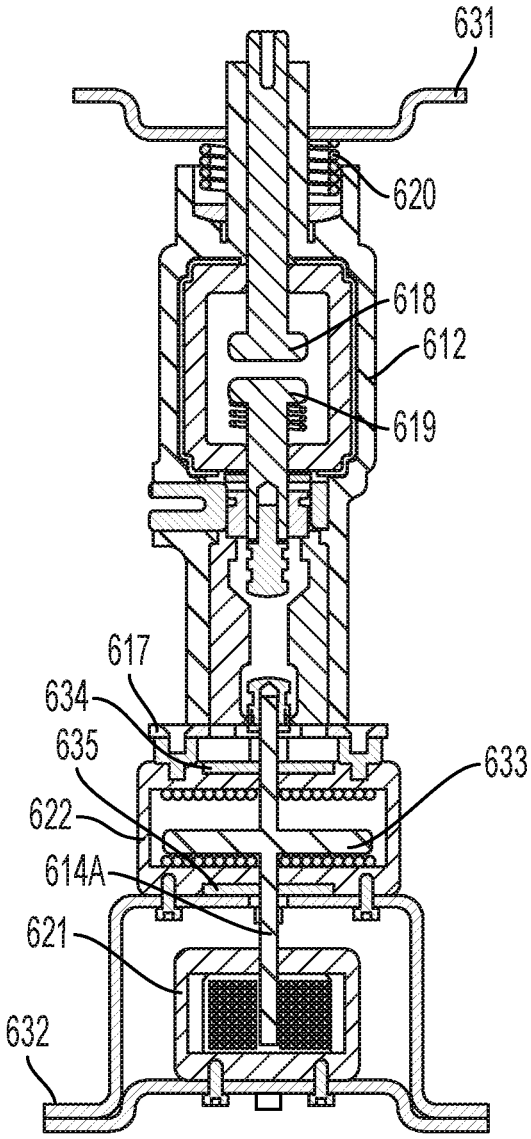
FIG. 7B illustrates a cross-sectional view of the second variation in an open position.

FIGS. 6A and 6B, along with the cross-sectional views of FIGS. 7A and 7B, illustrate the variation in which the high-speed actuator 622 is positioned between the linear actuator 621 and the pole unit 612. In this embodiment the non-conductive rod component 614A of the linkage extends through the entire high-speed actuator, including both coils of a dual Thomson coil actuator when used. The linkage also may include a conductive plate 633 that is larger than the coil openings through which component 614A travels, and which is positioned between the coils to limit the path of travel of component 614A within the high-speed actuator. In this variation, the stop member 617 is connected to the high-speed actuator 622 instead of to the linear actuator 621. One of the mounting structures 632 serves to interconnect the linear actuator 621 and the high-speed actuator 622 while maintaining a distance between the two actuators along which a component 614A of the linkage 614 may be withdrawn to open the contacts 618, 619 within the vacuum interrupter 613 (as shown in FIG. 7B), and also released to close the contacts 618, 619 (as shown in FIG. 7A).

FIG. 7A illustrates that when the contacts 618, 619 are closed, the resilient member 620 will be in a non-extended position and a gap will 626 will exist between the pole unit 612 and the high-speed actuator 622. In operation, one or more drivers (such as driver 120 in FIG. 3) may cause the high-speed actuator 622) to first actuate, energize and draw the linkage 614 toward it, separating the contacts 618, 619 in the vacuum interrupter 613. After the high-speed actuator 622 is engaged, and either while it is still engaged or upon completion of its operation, the driver may actuate the linear actuator 621, which will apply a force to linkage 614 to try to further separate and extend the gap between the contacts 618, 619. However, because the path of travel of the linkage 14 will be restricted when the high-speed actuator 612 has pulled the linkage 614 to the end of its path of travel, the force of the linear actuator 621 on the linkage 614 will draw the entire pole unit 621 toward the high speed actuator 622, thus extending the gap between the contacts 618, 619, extending resilient member 620, and reducing or eliminating the gap 626 between the pole unit 612 and linear actuator 621 will be reduced, optionally until the pole unit 612 reaches the stop member 617.

As with the other embodiments, in this embodiment when the high speed actuator 622 is a Thomson coil actuator, it may include permanent magnets 634, 635 positioned proximate to each Thomson coil, and a permanent magnet on a conductive plate 633, that will latch the conductive plate 633 with the Thomson coil to which it is adjacent. When a Thomson coil to which the conductive plate is latched is energized, the magnetic repulsion force will push the conductive plate 633 toward the other Thomson coil (and its corresponding permanent magnet 634 or 635 and operate to de-latch the conductive plate 633 from its current position.

The variation shown in FIGS. 6A-7B shows the resilient member 620 extending from pole unit 612 toward the mounting bracket 631 (as in the embodiment of FIGS. 1A-2B). However, this is for illustrative purposes only, and it is contemplated that instead of this structure the resilient member 620 could extend from an isolating component as shown in the embodiment of FIGS. 4A-5B.

The illustrations shown in this document show the fixed electrode located at an upper portion of the breaker, the moveable electrode at a lower portion of the breaker, and the actuators positioned below the moveable electrode. However, the invention includes embodiments in which the arrangements are inverted, rotated to an angle (such as by 90 degrees to form a linear/horizontal arrangement), or otherwise. Embodiments also include arrangements in which a single set of actuators are connected to multiple pole units, as in a three-phase AC system. In such arrangements, the actuators may be connected to an operative arm, and the operative arm may be connected to the linkages of all three pole units.

Figure 8:
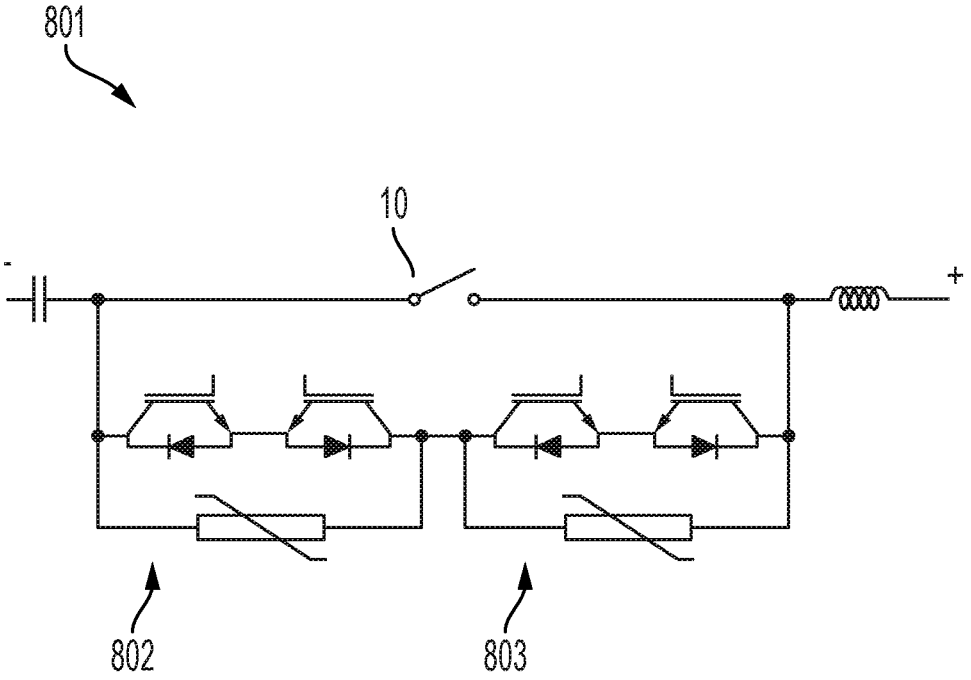
FIG. 8 is a diagram that illustrates various components that a medium voltage hybrid circuit breaker may include.

Additionally, the embodiments described above may be used in medium voltage applications, although other applications such as low voltage or high voltage applications may be employed. The circuit breakers also may be employed in a hybrid circuit breaker that includes both solid state and vacuum interrupter components such as shown in FIG. 8. FIG. 8 illustrates example components of a medium voltage DC hybrid circuit breaker 801 with which a vacuum interrupter switch 10 such as that described above may be employed. FIG. 8 illustrates that the medium voltage DC hybrid circuit breaker 801 will include one or more solid state switches 802, 803. The solid state switches 802, 803 will be electrically connected in series with each other, and in parallel with the vacuum interrupter switch 10, between a line and a load.

The features and functions described above, as well as alternatives, may be combined into many other different systems or applications. Various alternatives, modifications, variations or improvements may be made by those skilled in the art, each of which is also intended to be encompassed by the disclosed embodiments.

The invention claimed is:

1. A circuit breaker comprising:

a pole unit comprising:

a moveable electrode that leads to a moveable contact, and a fixed electrode that leads to a fixed contact, and a first end that is relatively proximate to the fixed electrode, and a second end that is relatively proximate to the moveable electrode;

a resilient member operably connected to and positioned proximate to the first end of the pole unit;

a linkage that extends from the second end of the pole unit;

a linear actuator that is operably connected to the linkage and located away from the pole unit; and a high-speed actuator that is also operably connected to the linkage, wherein:

the high-speed actuator is operable to move the linkage at a speed that is faster than a speed by which the linear actuator can move the linkage, and a gap is provided between the pole unit and the linear actuator or the high-speed actuator when the resilient member is not in an extended position, and the gap is reduced or eliminated when the resilient member is in an extended position.

2. The circuit breaker of claim 1, wherein:

the linear actuator is positioned between the pole unit and the high-speed actuator; and the gap is positioned between the pole unit and the linear actuator.

3. The circuit breaker of claim 1, wherein:

the high-speed actuator is positioned between the pole unit and the linear actuator; and the gap is positioned between the pole unit and the high-speed actuator.

4. The circuit breaker of claim 1, wherein the high-speed actuator comprises a Thomson coil actuator.

5. The circuit breaker of claim 4, wherein:

the Thomson coil actuator comprises a first Thomson coil, a second Thomson coil, and a conductive plate positioned between the first and second Thomson coils; and the linkage passes through the first Thomson coil and is positioned to be driven by the conductive plate.

6. The circuit breaker of claim 1, wherein the resilient member is at least partially contained inside of the pole unit.

7. The circuit breaker of claim 1, wherein the resilient member is at least partially positioned outside of the pole unit.

8. The circuit breaker of claim 1, further comprising a driver that is configured to open the circuit breaker by:

energizing the high-speed actuator to draw the linkage and separate the contacts by a distance; and after energizing the high-speed actuator, energizing the linear actuator to apply a force to the linkage that will pull the pole unit toward the linear actuator, thus increasing the distance between the contacts, extending the resilient member, and reducing or closing the gap.

9. The circuit breaker of claim 1, wherein:

the pole unit further comprises a vacuum chamber; and the fixed electrode and the movable electrode are contained within the vacuum chamber.

10. The circuit breaker of claim 1, further comprising a stop member that is positioned at an end of the gap to limit travel of the pole unit toward the linear actuator.

11. A circuit breaker comprising:

a pole unit comprising:

a vacuum chamber that contains a moveable contact and a fixed contact, a first end that is relatively proximate to the fixed contact, and a second end that is relatively proximate to the moveable contact;

a resilient member operably connected to and positioned proximate to the first end of the pole unit;

a linkage that extends from the second end of the pole unit;

a linear actuator that is operably connected to the linkage and located away from the pole unit; and a high-speed Thomson coil actuator that is also operably connected to the linkage, wherein the high-speed actuator is operable to move the linkage at a speed that is faster than a speed by which the linear actuator can move the linkage, wherein:

a gap is provided between the pole unit and the linear actuator or the high-speed actuator when the resilient member is not in an extended position, and the gap is reduced or eliminated when the resilient member is in an extended position.

12. The circuit breaker of claim 11, wherein:

the Thomson coil actuator comprises a first Thomson coil, a second Thomson coil, and a conductive plate positioned between the first and second Thomson coils; and the linkage passes through the first Thomson coil and is positioned to be driven by the conductive plate.

13. The circuit breaker of claim 11, wherein:

the linear actuator is positioned between the pole unit and the high-speed actuator; and the gap is positioned between the pole unit and the linear actuator.

14. The circuit breaker of claim 11, wherein:

the high-speed actuator is positioned between the pole unit and the linear actuator; and the gap is positioned between the pole unit and the high-speed actuator.

15. The circuit breaker of claim 11, wherein the resilient member is at least partially contained inside of the pole unit.

16. The circuit breaker of claim 11, wherein the resilient member is at least partially positioned outside of the pole unit.

17. The circuit breaker of claim 11, further comprising a driver that is configured to open the circuit breaker by:

energizing the high-speed actuator to draw the linkage and separate the contacts by a distance; and after energizing the high-speed actuator, energizing the linear actuator to apply a force to the linkage that will pull the pole unit toward the linear actuator, thus increasing the distance between the contacts, extending the resilient member, and reducing or closing the gap.

18. A method of operating a circuit breaker, the method comprising:

providing a circuit breaker that comprises:

a pole unit that includes a moveable contact and a fixed contact, the pole unit having a first end that is relatively proximate to the moveable contact and a second end that is relatively proximate to the fixed contact, a linkage that extends from the first end of the pole unit, a linear actuator that is operably connected to the linkage and located away from the pole unit so that, and a high-speed actuator that is also operably connected to the linkage and that is operable to move the linkage at a speed that is faster than a speed by which the linear actuator can move the linkage, wherein a gap is provided between the pole unit and the linear actuator or the high-speed actuator when the moveable contact and the fixed contact are in a closed position;

energizing the high-speed actuator to draw the linkage and separate the moveable contact and the fixed contact by a distance; and after energizing the high-speed actuator, energizing the linear actuator to apply a force to the linkage that will pull the pole unit toward the linear actuator, thus increasing the distance between the moveable contact and the fixed contact and reducing or closing the gap.

19. The method of claim 18, wherein:

the circuit breaker further comprises a resilient member that is operably connected to and positioned proximate to the second end of the pole unit; and energizing the linear actuator extends the resilient member.

20. The method of claim 18, wherein:

the high-speed actuator comprises a first Thomson coil, a second Thomson coil, and a conductive plate positioned between the first and second Thomson coils;

the linkage passes through the first Thomson coil and is positioned to be driven by the conductive plate; and energizing the high-speed actuator comprises energizing the second Thomson coil to generate a magnetic force that repels the conductive plate away from the first Thomson coil and toward the second Thomson coil to drive the linkage to pull the moveable contact away from the fixed contact.

* * * * *